US009016270B2

(12) United States Patent
Chezem et al.

(10) Patent No.: US 9,016,270 B2
(45) Date of Patent: Apr. 28, 2015

(54) WINDOW MOUNTING FOR THERMAL EXPANSION IN AN OVEN APPLIANCE

(75) Inventors: Michael Thomas Chezem, Georgetown, IN (US); Philip Ames Barber, Louisville, KY (US); John Mark Chilton, Campbellsburg, KY (US); Cecil Clay Clements, Louisville, KY (US); Carlos Garcia, Queretaro (MX)

(73) Assignee: General Electric Company, Schenectady, NY (US)

( * ) Notice: Subject to any disclaimer, the term of this patent is extended or adjusted under 35 U.S.C. 154(b) by 297 days.

(21) Appl. No.: 12/984,681

(22) Filed: Jan. 5, 2011

(65) Prior Publication Data

US 2012/0167866 A1 Jul. 5, 2012

(51) Int. Cl.
*F23M 7/00* (2006.01)
*F24C 15/04* (2006.01)

(52) U.S. Cl.
CPC ..... *F24C 15/04* (2013.01)

(58) Field of Classification Search
CPC ..... F24C 15/04
USPC ..... 126/190, 198, 200
See application file for complete search history.

(56) References Cited

U.S. PATENT DOCUMENTS 943,548 A * 12/1909 Huenefeld ..... 126/200
943,549 A * 12/1909 Huenefeld ..... 126/200
965,906 A * 8/1910 Huenefeld ..... 126/200
966,017 A * 8/1910 Huenefeld ..... 126/200
1,111,352 A * 9/1914 Berry ..... 126/200
2,612,154 A * 9/1952 Mills ..... 126/200
2,710,994 A * 6/1955 Mills ..... 52/208
3,168,089 A * 2/1965 Larkin ..... 126/200
3,170,456 A * 2/1965 Moss et al. ..... 52/786.1
3,250,268 A * 5/1966 More et al. ..... 126/200
3,339,541 A 9/1967 Evans
3,453,997 A * 7/1969 Klepzig ..... 126/198
3,818,890 A * 6/1974 Evans et al. ..... 126/200
3,877,460 A * 4/1975 Lotz et al. ..... 126/200
4,007,727 A * 2/1977 Krebs ..... 126/200
4,041,930 A * 8/1977 Katona ..... 126/198
4,074,677 A * 2/1978 Lotz ..... 126/198
4,253,286 A * 3/1981 Katona ..... 52/171.1
4,264,800 A * 4/1981 Jahnke et al. ..... 219/740
4,384,567 A * 5/1983 Katona ..... 126/200
4,390,767 A * 6/1983 Bucksbaum et al. ..... 219/740
4,525,614 A * 6/1985 Ishino et al. ..... 219/743
4,577,079 A * 3/1986 Sujaku ..... 219/740
4,606,324 A * 8/1986 Katona ..... 126/198
4,817,585 A * 4/1989 Craver ..... 126/200
5,022,380 A * 6/1991 Faurel et al. ..... 126/190
5,735,261 A * 4/1998 Kieslinger ..... 126/190
5,819,722 A * 10/1998 Katz ..... 126/200
6,561,180 B1 * 5/2003 Austin et al. ..... 126/198
7,655,885 B2 * 2/2010 Kim et al. ..... 219/391
7,703,451 B2 * 4/2010 Bang ..... 126/190
7,819,113 B2 * 10/2010 Chin ..... 126/200
2004/0232133 A1 * 11/2004 Roch et al. ..... 219/393

(Continued)

*Primary Examiner* — Avinash Savani
*Assistant Examiner* — George R Blum
(74) *Attorney, Agent, or Firm* — Dority & Manning, P.A.

(57) ABSTRACT

Mounting for a window in an oven appliance is provided so as to allow for thermal expansion during oven use. More particularly, an expansion zone is provided around the window such that, during heating of the window from oven operation, the window is allowed to expand without restraint that could cause cracking or shattering. Space can be allowed for both lateral and longitudinal expansion of the window.

17 Claims, 4 Drawing Sheets

(56) References Cited

U.S. PATENT DOCUMENTS

2007/0023029 A1* 2/2007 Kelley et al. ..... 126/198
2012/0060822 A1* 3/2012 Eberhard ..... 126/198
2012/0216789 A1* 8/2012 Vazquez Garcia et al. ... 126/200
2012/0298095 A1* 11/2012 Saporetti et al. ..... 126/192

* cited by examiner

WINDOW MOUNTING FOR THERMAL EXPANSION IN AN OVEN APPLIANCE

FIELD OF THE INVENTION

The present invention relates to the mounting of a window in an oven appliance so as to allow for thermal expansion during oven use.

BACKGROUND OF THE INVENTION

Oven appliances frequently include a window for the user to view the contents of the oven during cooking Allowing the user to view food without opening the door is convenient and avoids the escape of heat, steam, and fumes that occurs by opening the door. Viewing the food allows the user to check on e.g., cooking progress and browning. One or more lights in the oven cavity may also be provided to assist with viewing.

To allow for the window, an opening is created in the oven door. To prevent the escape of heat, the window includes one more pieces of glass or other transparent material through which the user can view the oven cavity. The glass may be treated for easier cleaning and exposure to the temperatures of oven use and may also include other features for oven application. If, for example, the oven is a microwave or includes microwave features, the window may include a layer of mesh to assist with shielding. Different types of glass can be used to provide the oven window.

During cooking operations, the oven is operated at temperatures that may exceed 450° F. For oven self-cleaning cycles, even higher temperatures may be obtained. Insulation is typically provided around the oven to insulate the user and the environment from these temperatures. For the oven window, several layers of glass may be used in order to provide insulation between the oven cavity and the exterior of the appliance while still allowing viewing through the window.

Like many other materials, glass will grow as its temperature is raised by heating. For example, plate glass can have a linear thermal expansion coefficient of about 5.0×10-6 in/in ° F. As such, the glass installed in an oven window, particularly glass that is exposed directly to the heat of the oven cavity, can expand significantly along both lateral and longitudinal directions as its temperature is increased.

Such thermal expansion presents certain challenges in the design and manufacture of an oven appliance. Where a window contacts or attaches to an oven door, consideration must be given to the relative movement of the glass that will occur due to the thermal expansion. Restraint of such movement during heating can lead to e.g., glass damage such as cracking or shattering.

Previous approaches to positioning the window while allowing for thermal expansion are varied. For example, adhesives or gaskets have been applied in various configurations as well as special mounting procedures when fasteners are used that extend through the glass. Combinations of these approaches have also been applied.

Accordingly, an oven appliance that allows for the thermal expansion of a window used for viewing the oven cavity would be useful. More particularly, an oven appliance that can allow the glass window to expand along both its lateral and longitudinal directions without causing damage to the glass would be beneficial. Such an oven that can allow for such expansion without the use of special adhesives or gaskets would also be very useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides an oven appliance. This oven appliance includes a cabinet defining a cavity for the receipt of food items. A door is connected to the cabinet and is configured for allowing the user to selectively open and close the cavity. A frame is positioned along a side of the door. A window is received into the frame. The frame and the window define an expansion zone adjacent to the window. The expansion zone provides space into which the window can expand due to heating.

In another exemplary embodiment of the present invention, an oven is also provided having a cabinet defining a cavity for the receipt of food items. A door is hingedly connected to the cabinet whereby a user may access the cabinet during cooking. The door defines an opening for the user to view the contents of the cavity. A window covers the opening defined by the door. The window defines a top longitudinal edge and a bottom longitudinal edge. An upper retainer is supported by the door and is positioned along the top longitudinal edge of the window. The upper retainer and window define space for both the longitudinal and lateral expansion of the window during heating. A lower retainer is supported by the door and is positioned along the bottom longitudinal edge of the window. The window is supported by the lower retainer. The lower retainer and the window define space for the longitudinal expansion of the window during heating.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
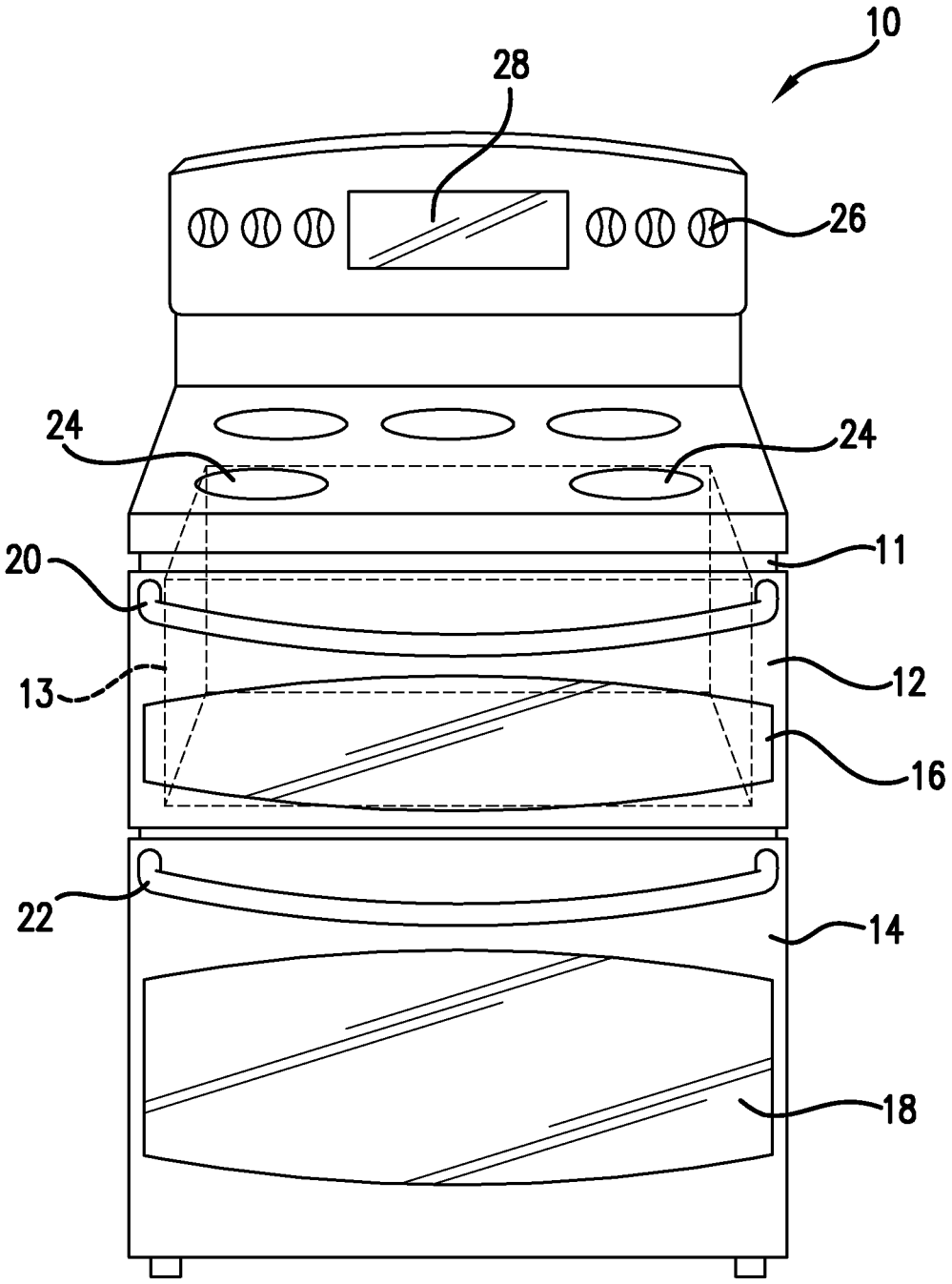
FIG. 1 provides a front view of a free-standing range with double ovens according to an exemplary embodiment of the present invention.

The present invention provides for the mounting of a window in an oven appliance so as to allow for thermal expansion during oven use. More particularly, an expansion zone is provided around the window such that, during heating of the window from oven operation, the window is allowed to expand without restraint that could cause cracking or shattering. Space can be allowed for both lateral and longitudinal expansion of the window.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a range oven 10 as may be used in an exemplary embodiment of the present invention. Oven 10 includes a cabinet 11 to which are attached an upper oven door 12 and a lower oven door 14. Oven 10 defines an upper oven cavity 13 for the receipt of food for cooking A lower oven cavity (not shown) is accessed through lower oven door 14. Handles 20 and 22 are provided with doors 12 and 14, respectively. Below such handles, each door 12 and 14 includes a window 16 and 18, respectively, for the viewing of the oven cavities during, e.g., cooking and self-cleaning.

The top of oven 10 includes multiple heating elements 24. Each element 24 is configured to receive a pot or pan for the cooking of food. Heating elements 24 as well as the temperatures of the oven cavities are determined using controls 26. A display panel 28 can provide information to the user such as oven temperatures, cooking time, and other features that may be provided.

Oven 10 is provided by way of example only. Other oven appliances having a cooking cavity and a window for which thermal protection is desired may also be used with the present invention. For example, single oven units, built-in ovens, microwave ovens, and other appliance configurations may also be used with the present invention.

Figure 2:
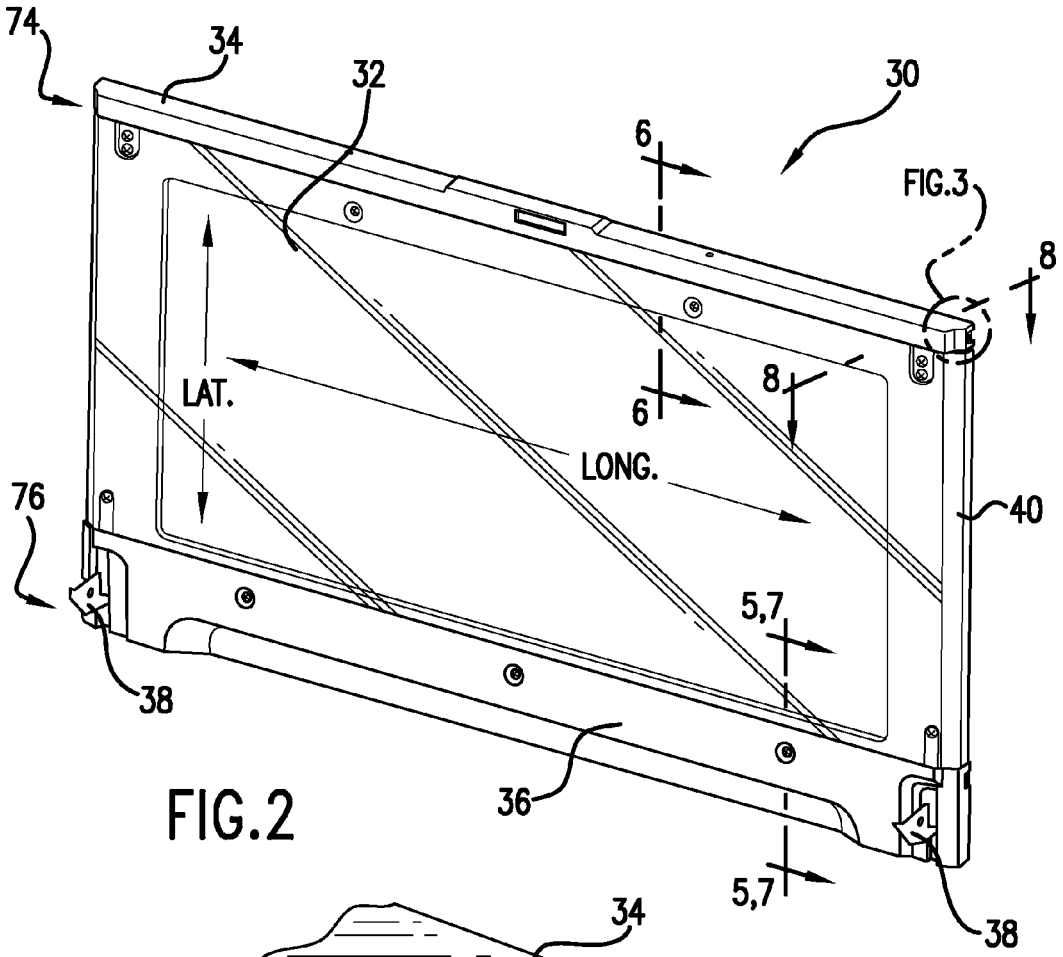
FIG. 2 illustrates a rear view of an exemplary embodiment of an oven door such as either of the doors shown in FIG. 1.

FIG. 2 is a rear view of an exemplary embodiment of an oven door 30 according to the present invention, which could be used e.g. for either of doors 12 or 14 on oven 10. Here, "rear view" denotes the side of oven door 30 that would be facing the interior cooking cavity of the oven, such as cavity 13. More particularly, the side of oven door 30 shown in FIG. 1 is directly exposed to the heat generated during cooking Door 30 is attached to an oven using a pair of hinges 38.

Door 30 includes a glass liner 32 that forms a window through which the user may look through door 30. As previously described, due to the temperature increase from heat applied by oven 10, glass liner 32 will expand along the lateral and longitudinal directions as denoted in FIG. 2 with arrows for LAT. and LONG. The amount of such expansion will depend upon e.g., the degree of temperature change caused by heating and the linear thermal expansion coefficient for the particular glass used in constructing glass liner 32. Accordingly, door 30 includes an expansion zone to allow for such thermal expansion without damaging glass liner 32 as will be more fully described below.

Continuing with FIG. 2, door 30 includes a frame constructed from upper retainer 34 and lower retainer 36, which are each attached to a liner door 40. More particularly, upper retainer 34 is positioned along a top door edge 74 while lower retainer 36 is positioned along a bottom door edge 76. Glass liner 32 is framed by retainers 34 and 36 and is positioned between such retainers and liner door 40.

Figure 3:
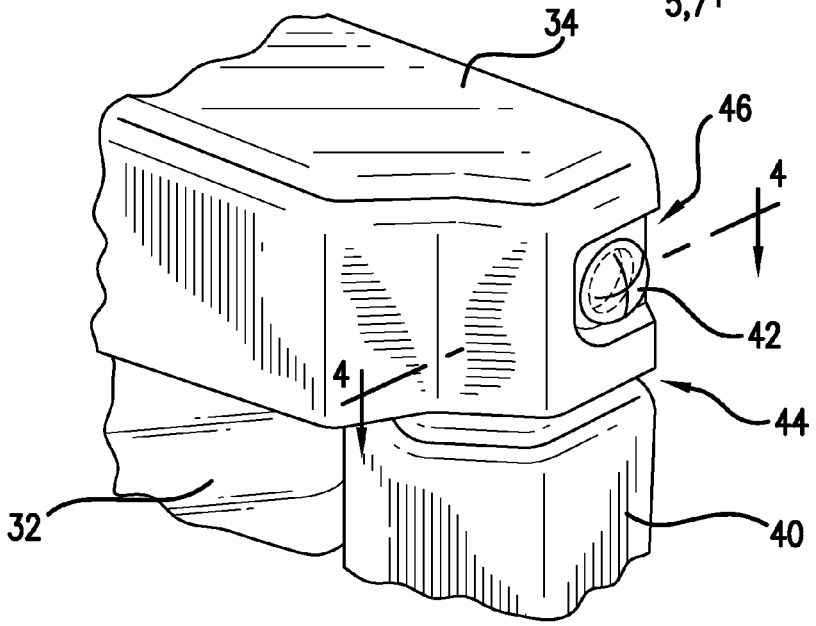
FIG. 3 provides a detail of one corner of the exemplary embodiment of the oven door shown in FIG. 2, taken at the location identified in FIG. 2.

FIG. 3 provides a detail view of one corner of the exemplary embodiment of oven door 30, taken along top door edge 74 at the location identified in FIG. 2. As shown, liner door 40 includes a slight recess 44 into which upper retainer 34 is received. A fastener 42, received into recess 46, is used to attach upper retainer 34 securely to liner door 40. A similar arrangement as shown in FIG. 3 is used on both sides of door 30, only one side being shown in the figures for purposes of description.

Figure 4:
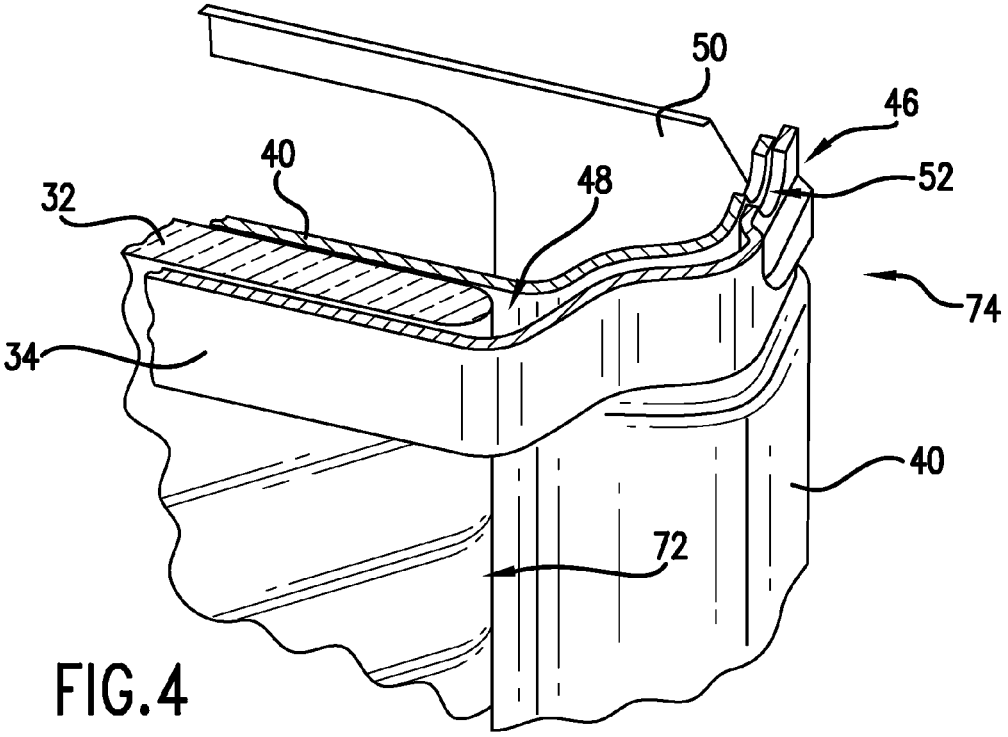
FIG. 4 is a cross-sectional view of the exemplary embodiment of the oven door shown in FIG. 2, taken along line 4-4 as shown in FIG. 3.
Figure 8:
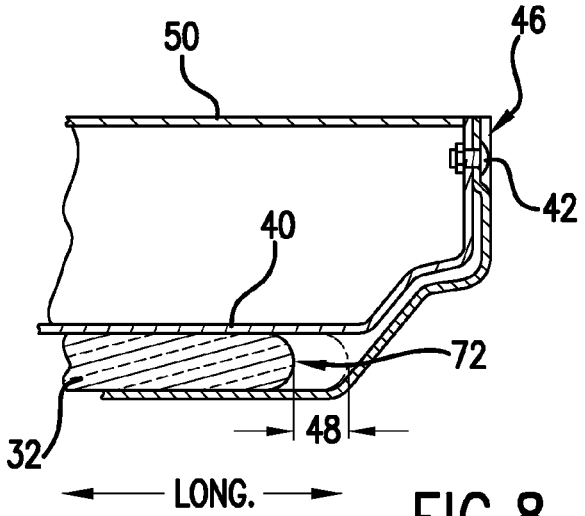
FIG. 8 is a cross-sectional view of the exemplary embodiment of the oven door shown in FIG. 2, taken along line 8-8 as shown in FIG. 2.

FIG. 4 is a cross-sectional view of the exemplary embodiment of the oven door 30 shown in FIG. 2, taken along line 4-4 as shown in FIG. 3. As such, FIG. 4 shows a view of a corner of oven door 30 cut through a portion of upper retainer 34. A panel 50 is shown that is connected with liner door 40. Additional glass panels and insulation as might be located between panel 50 and liner door 40 are not shown for in this view for purposes of additional clarity. FIG. 8 provides another view of this same corner of oven door 30, taken as a cross-section along line 8-8 as shown in FIG. 2.

Referring now to both FIG. 4 and FIG. 8, glass liner 32 defines a lateral edge 72, one of two such edges for glass liner 32. Together, the lateral edge 72 of glass liner 32 and upper retainer 34 define an expansion zone, which includes a space 48 adjacent to glass liner 32 into which glass liner 32 may extend. More specifically, during heating by oven 10, glass liner 32 can expand along its longitudinal direction (FIG. 2) into the space 48 provided by the expansion zone. FIG. 8 shows the movement of lateral edge 72 in phantom lines. As the oven 10 temperature is reduced, glass liner 32 will cool and subsequently contract along the longitudinal direction within space 48 of the expansion zone. The cycle can be repeated for each use of oven 10.

Figure 6:
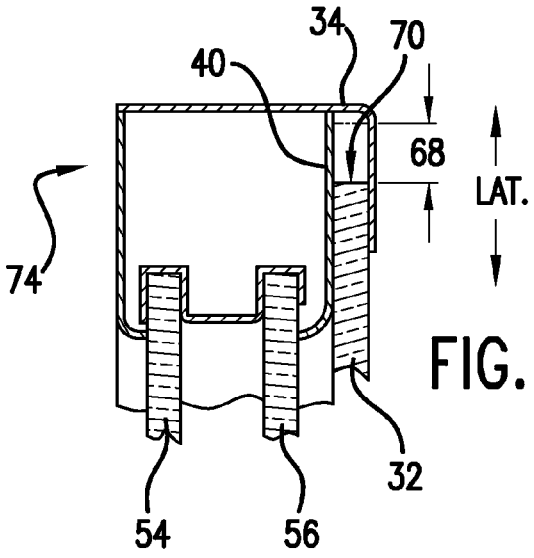
FIG. 6 is a cross-sectional view of the exemplary embodiment of the oven door shown in FIG. 2, taken along line 6-6 as shown in FIG. 2.

Door 30 also provides space for the thermal expansion of glass liner 32 along the lateral direction (identified as LAT. in FIG. 2). FIG. 6 is a cross-sectional view of the top door edge 74 of the exemplary embodiment of the oven door 30 shown in FIG. 2, taken along line 6-6 as shown in FIG. 2. Door 30 includes two additional glass walls 54 and 56 that are provided as additional insulation between the heated oven cavity and the exterior of the oven 10. Glass walls 54 and 56 are shielded from direct exposure to the heated oven cavity by glass liner 32. As a result, the amount of temperature increase and, therefore, thermal expansion of glass walls 54 and 56 will be less than for glass liner 32.

As shown in FIG. 6, glass liner 32 includes a top longitudinal edge 70. Together, longitudinal edge 70 of glass liner 32 and upper retainer 34 define another part of the expansion zone as a space 68 adjacent to glass liner 32 into which glass liner 32 may extend. More specifically, during heating by oven 10, glass liner 32 can expand along its lateral direction (FIG. 2) into space 68 provided as part of the expansion zone for liner 32. FIG. 6 shows the movement of longitudinal edge 72 in phantom lines. As the oven 10 temperature is reduced, glass liner 32 will cool and subsequently contract along the lateral direction within space 68. The cycle can be repeated for each use of oven 10.

Figure 5:
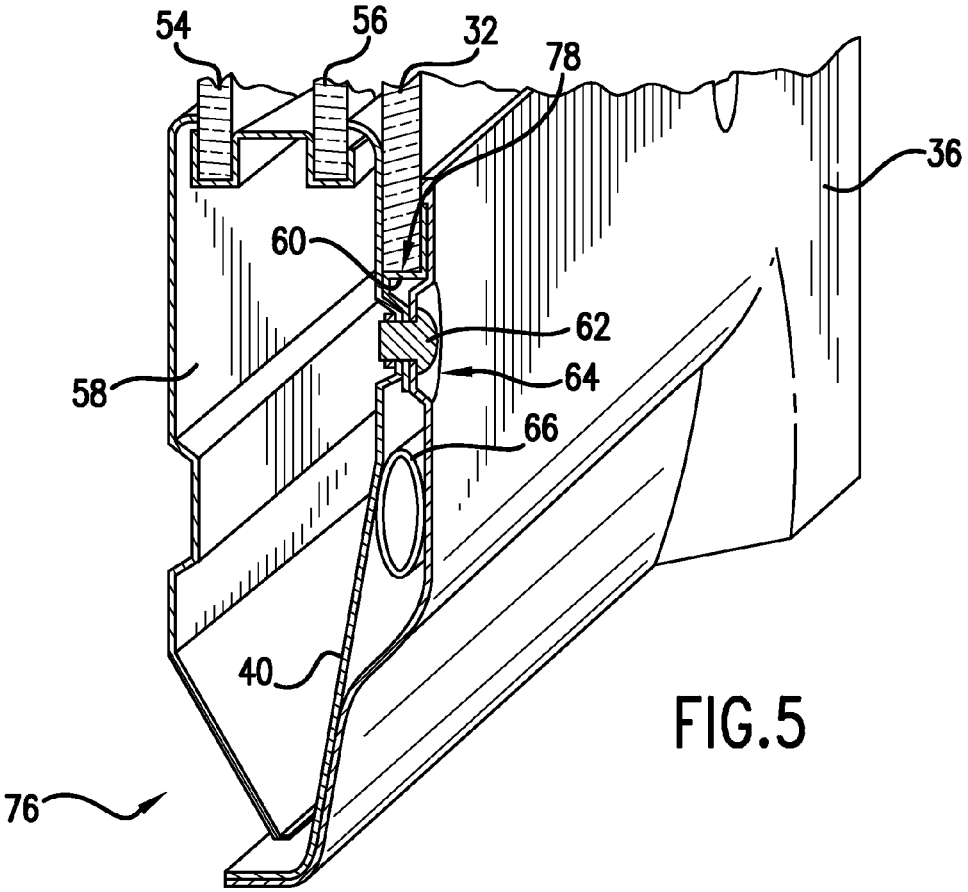
FIG. 5 is a partial perspective and cross-sectional view of the exemplary embodiment of the oven door shown in FIG. 2, taken along line 5-5 as shown in FIG. 2.
Figure 7:
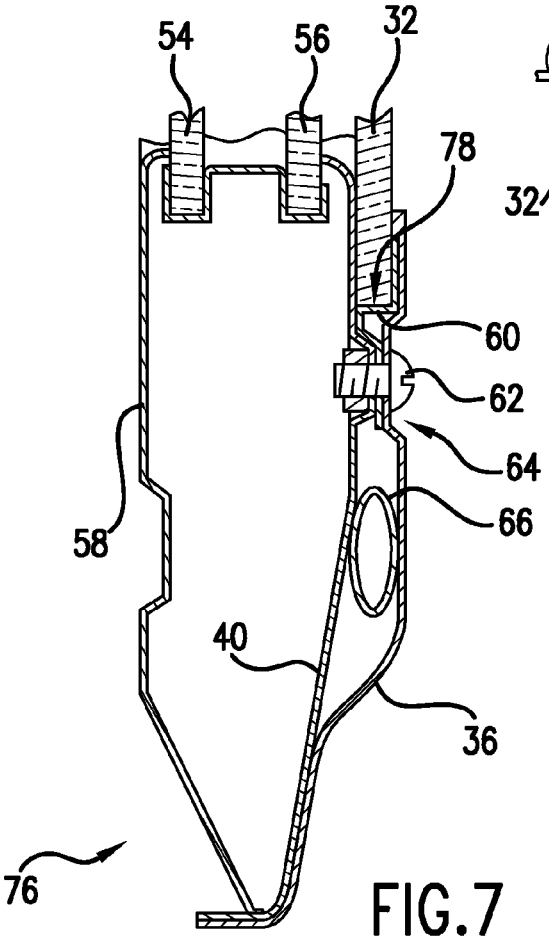
FIG. 7 is a partial, cross-sectional view of the exemplary embodiment of the oven door shown in FIG. 2, taken along line 7-7 as shown in FIG. 2.

FIGS. 5 and 7 illustrate the support of glass liner 32 along the bottom door edge 76. FIG. 5 is a partial perspective and cross-sectional view of the exemplary embodiment of the oven door shown in FIG. 2, taken along line 5-5 as shown in FIG. 2. FIG. 7 is a partial, cross-sectional view of the exemplary embodiment of the oven door shown 2, taken along line 7-7 as shown in FIG. 2. Glass liner 32 rests on a support trim 60 that is positioned between lower retainer 36 and liner door 40. A fastener 62 in recess 64 secures support trim 60 between lower retainer 36 and liner door 40. Glass liner 32 also defines a bottom longitudinal edge 78. Support trim 60 is configured for mating receipt of edge 78 in that support trim 60 is shaped to match edge 78. A thermal break 66 is positioned between lower retainer 36 and liner door 40.

Accordingly, door 30 includes a frame that captures glass liner 32 and provides an expansion zone, in the form of gaps or spaces 48 and 68, which allow for the longitudinal and lateral expansion, respectively, of glass liner 32. The size of spaces 48 and 68 can be determined based upon e.g., the maximum amount of thermal expansion of glass liner 32. More particularly, by knowing the linear thermal expansion coefficient for the material used to construct glass liner 32, and the maximum temperature of use expected for oven 10, one can determine the maximum amount of expansion along the lateral and longitudinal directions that is anticipated for liner 32.

As described, the frame for door 30 includes a combination of upper retainer 34, lower retainer 36, and support trim 60. It will be understood by one of ordinary skill in the art, using the teachings disclosed herein, that door 30 can be framed using other constructions as well—the above being provided by way of an exemplary embodiment of the invention only.

Thus, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising;

a cabinet defining a cavity for receipt of food items;

a door connected to said cabinet and configured for allowing a user to selectively open and close the cavity, said door defining a top door edge, said door having a liner;

a glass wall mounted to the door;

a frame positioned along a side of said door and supported by said door, said frame having an upper retainer attached to said door along the top door edge, the upper retainer having a top wall and a side wall, the side wall of the upper retainer extending from the top wall of the upper retainer, the top wall of the upper retainer positioned on said door and extending along the top door edge, the side wall of the upper retainer received in a recess defined by said door at a corner of said door;

a window received into said frame such that said window is positioned between and contacts the upper retainer of said frame and the liner of said door, said window having a top edge positioned proximate the top door edge of said door, said window positioned adjacent and exposed to the cavity of said cabinet when the door is in a closed position, the window positioned between the glass wall and the cavity of said cabinet when the door is in the closed position, a lateral width of the window being greater than a lateral width of the glass wall, a longitudinal width of the window being greater than a longitudinal width of the glass wall, the side wall of the upper retainer extending along the longitudinal width of said window at the top edge of said door;

a lower retainer supported by said door and positioned along a bottom longitudinal edge of said window, said window positioned between said lower retainer and said door, said lower retainer and said window defining space for the longitudinal expansion of said window during heating; and a support trim positioned between said door and said lower retainer, said window resting on said support trim;

wherein said frame and said window define an expansion zone adjacent to said window that provides space into which said window expands when said window is heated.

2. An oven appliance as in claim 1, wherein said expansion zone is configured to allow for lateral expansion of said window.

3. An oven appliance as in claim 1, wherein said expansion zone is configured to allow for longitudinal expansion of said window.

4. An oven appliance as in claim 1, said window defining a lateral edge, wherein said expansion zone is defined between said lateral edge and said frame.

5. An oven appliance as in claim 1, said window defining a longitudinal edge, wherein said expansion zone is defined between said longitudinal edge and said frame.

6. An oven appliance as in claim 5, said window defining a lateral edge, wherein said expansion zone is further defined between said longitudinal edge and said frame.

7. An oven appliance as in claim 1, wherein said frame comprises a lower retainer, and wherein the oven appliance further comprises a support trim, said support trim positioned between said door and said lower retainer, and said window resting on said support trim.

8. An oven appliance as in claim 1, further comprising extending through the upper retainer and said door at the recess of said door.

9. An oven appliance as in claim 1, wherein said window is positioned between said door and the cavity defined by said cabinet.

10. An oven appliance as in claim 9, wherein the expansion zone is configured at a width that allows for the maximum expansion of said window that is anticipated during operation of the oven appliance.

11. An oven appliance, comprising;

a cabinet defining a cavity for receipt of food items;

a door hingedly connected to said cabinet whereby a user may access said cabinet during cooking, said door defining an opening for the user to view contents of said cavity, said door defining a top door edge;

a glass wall mounted to the door at the opening of said door;

a window covering the opening defined by said door, said window positioned adjacent and exposed to the cavity of said cabinet when the door is in a closed position, the window positioned between the glass wall and the cavity of said cabinet when the door is in the closed position, a lateral width of the window being greater than a lateral width of the glass wall, a longitudinal width of the window being greater than a longitudinal width of the glass wall, said window defining a top longitudinal edge and a bottom longitudinal edge, the top longitudinal edge of said window positioned proximate the top door edge of said door;

an upper retainer supported by said door and positioned along the top longitudinal edge of said window, the upper retainer having a top wall and a side wall, the side wall of the upper retainer extending from the top wall of the upper retainer, the top wall of the upper retainer positioned on said door and extending along the top door edge, the side wall of said upper retainer received in a recess defined by said door at a corner of said door, a fastener extending through said upper retainer into said door at the corner of said door, the side wall of the upper retainer extending along the longitudinal width of said window at the top edge of said door, said window positioned between and contacting said upper retainer and said door, said upper retainer and window defining space for both the longitudinal and lateral expansion of said window during heating;

a lower retainer supported by said door and positioned along the bottom longitudinal edge of said window, said window positioned between said lower retainer and said door, said lower retainer and said window defining space for the longitudinal expansion of said window during heating; and a support trim positioned between said door and said lower retainer, said window resting on said support trim.

12. An oven appliance as in claim 11, wherein said upper retainer and said lower retainer are attached to said door.

13. An oven appliance as in claim 11, further comprising a faster extending through the sidewall of said upper retainer and said door at the recess of said door.

14. An oven appliance as in claim 11, wherein said support trim is configured for mating receipt of the bottom longitudinal edge of said window.

15. An oven appliance as in claim 11, wherein said door defines a pair of recesses for he receipt of said upper retainer.

16. An oven appliance as in claim 11, wherein the space for thermal expansion is configured at a width that allows for the maximum expansion of said window that is anticipated during operation of the oven appliance.

17. An oven appliance, comprising a cabinet defining a cavity for receipt of food items;

a door connected to the cabinet, the door comprising a door liner having a top edge;

a glass wall mounted to the door liner;

a glass liner positioned adjacent and exposed to the cavity of the cabinet when the door is in a closed position, the glass liner positioned between the glass wall and the cavity of the cabinet when the door is in the closed position, a lateral width of the glass liner being greater than a lateral width of the glass wall, a longitudinal width of the glass liner being greater than a longitudinal width of the glass wall, the glass liner having a top edge positioned proximate the top edge of the door liner;

a frame having an upper retainer attached to the door liner at the top edge of the door liner, the upper retainer having a top wall and a side wall, the side wall of the upper retainer extending from the top wall of the upper retainer, the side wall of the said door liner, the top wall of the upper retainer positioned on said door liner and extending along the top edge, the side wall of the upper retainer received in a recess defined by said door liner at a corner of said door liner, the glass liner positioned between and contacting the upper retainer of the frame and the door liner, the frame and the glass liner defining an expansion zone adjacent the glass liner, the glass liner expanding into the expansion zone when the glass liner is heated;

a lower retainer positioned along a bottom longitudinal edge of said door liner, said glass liner positioned between said lower retainer and said door liner, said lower retainer and said glass liner defining space for the longitudinal expansion of said glass liner during heating; and a support trim positioned between said door and said lower retainer, said glass liner resting on said support trim.

* * * * *